US011470875B2

(12) United States Patent
Tweedie

(10) Patent No.: US 11,470,875 B2
(45) Date of Patent: Oct. 18, 2022

(54) GAS INHALATION DEVICES AND METHODS UTILIZING ELECTRICAL DISCHARGE

(71) Applicant: Xander Victor Tweedie, Los Angeles, CA (US)

(72) Inventor: Xander Victor Tweedie, Los Angeles, CA (US)

( * ) Notice: Subject to any disclaimer, the term of this patent is extended or adjusted under 35 U.S.C. 154(b) by 96 days.

(21) Appl. No.: 15/981,842

(22) Filed: May 16, 2018

(65) Prior Publication Data

US 2018/0332890 A1 Nov. 22, 2018

Related U.S. Application Data

(60) Provisional application No. 62/507,235, filed on May 17, 2017.

(51) Int. Cl.

| | |
|---|---|
| ***A24F 1/06*** | (2006.01) |
| ***A24F 7/00*** | (2006.01) |
| ***A24F 1/16*** | (2006.01) |

(52) U.S. Cl.

CPC ..... *A24F 1/06* (2013.01); *A24F 1/16* (2013.01); *A24F 7/00* (2013.01)

(58) Field of Classification Search

CPC ..... A24F 1/06; A24F 7/00
USPC ..... 131/328
See application file for complete search history.

(56) References Cited

U.S. PATENT DOCUMENTS

| | | | | |
|---|---|---|---|---|
| 3,070,100 | A * | 12/1962 | Beckett | A24F 1/00 131/200 |
| 9,016,274 | B1 * | 4/2015 | White | A61M 15/00 128/202.21 |
| 9,687,025 | B2 * | 6/2017 | Cyphert | A24F 1/00 |
| 9,763,478 | B2 * | 9/2017 | Cameron | H04M 1/72415 |
| 10,015,994 | B2 * | 7/2018 | Daryani | A24F 47/008 |
| 10,065,005 | B2 * | 9/2018 | Wilder | A61M 15/0021 |
| 10,172,386 | B2 * | 1/2019 | Besso | A24D 3/045 |

(Continued)

FOREIGN PATENT DOCUMENTS

CN 203952435 U * 11/2014

OTHER PUBLICATIONS

Electric Arc, Encyclopaedia Britannica, https://www.britannica.com/science/electric-arc (Year: 2020).*
Machine Translation of CN 203952435 (Year: 2014).*

*Primary Examiner* — Kelly M Gambetta
*Assistant Examiner* — Russell E Sparks
(74) *Attorney, Agent, or Firm* — Klarquist Sparkman, LLP

(57) ABSTRACT

The present disclosure relates to devices for inhaling gases, such as smoke or vapor, produced from a combustible material, as well to methods for producing these devices and methods for inhaling such gases. Devices according to the present disclosure utilize one or more electrical arcs for the combustion of the desired combustible material as opposed to prior art methods that utilize, e.g., fire. The electrical arcs produced by devices according to the present disclosure cause an electrical field to form that ionizes the gas to be inhaled by the user, and cause a larger proportion of negatively ionized particles to be ingested by the user. Methods for forming such devices, including methods for assembly that allow for access to electronic circuitry for forming the electrical arcs for, e.g., recharging purposes, are also described, as are methods for inhalation of the gas produced by the combustible material.

11 Claims, 11 Drawing Sheets

(56) References Cited

U.S. PATENT DOCUMENTS

| | | | | |
|---|---|---|---|---|
| 10,918,136 | B2 * | 2/2021 | Reevell | G01N 27/228 |
| 2015/0181934 | A1 * | 7/2015 | Lyubomirskiy | A24F 47/008 131/329 |
| 2019/0150508 | A1 * | 5/2019 | Thorsen | A24F 47/008 |
| 2019/0246691 | A1 * | 8/2019 | McCoy | A24F 1/06 |

* cited by examiner

SECTIONS P-P AND R-R

SECTION Q-Q

FIG. 7A
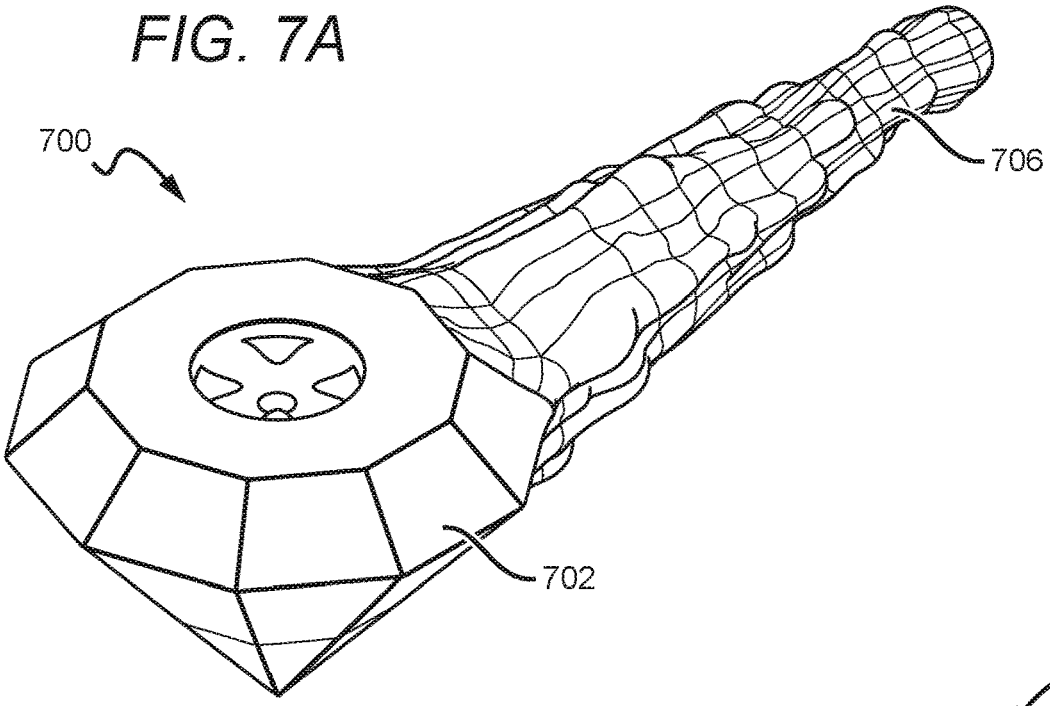
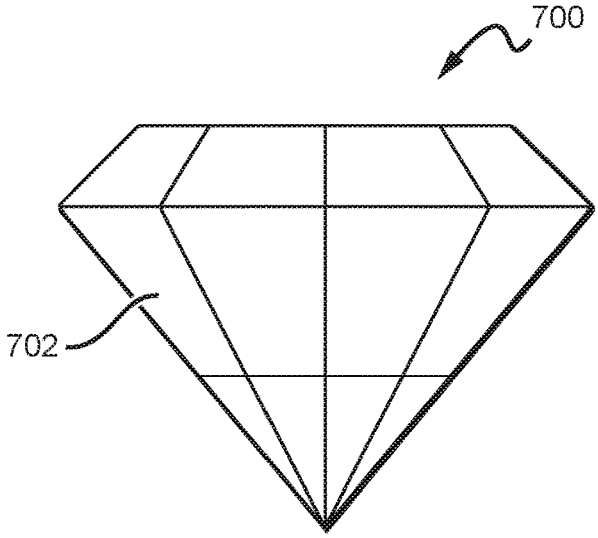
FIG. 7B
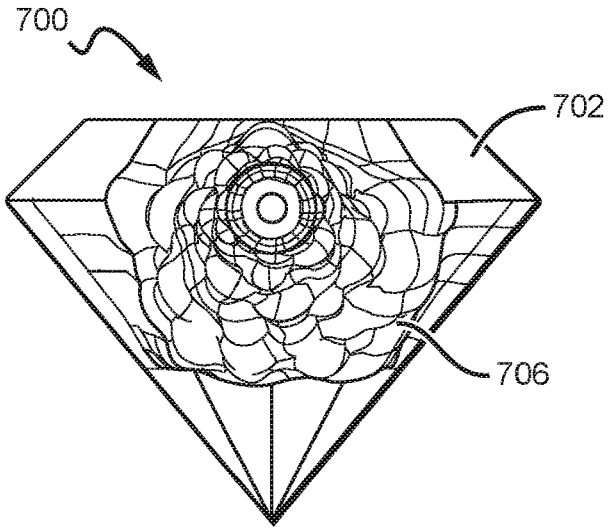
FIG. 7C

GAS INHALATION DEVICES AND METHODS UTILIZING ELECTRICAL DISCHARGE

RELATED PATENTS AND APPLICATIONS

This application claims the priority benefit of U.S. Provisional Patent Application No. 62/507,235 to Tweedie, filed on May 17, 2017 and entitled "Corona Discharge Smoking Device," the entire contents of which are incorporated by reference herein.

BACKGROUND OF THE INVENTION

Field of the Invention

Embodiments of the present invention relate to devices and methods for producing a gas, such as smoke or vapor, for inhalation by a user.

Description of the Related Art

Users often utilize a pipe as a device for inhaling the gas, such as smoke or vapor, produced by a combustible material when that material is lit and/or heated. Exemplary combustible materials include tobacco and *cannabis*, which has been increasingly accepted for adult consumption for medicinal and recreational purposes. These pipes are made from a wide variety of materials.

SUMMARY OF THE DISCLOSURE

One embodiment of a pipe for inhalation of gas produced by a combustible material according to the present disclosure comprises a pipe body, the pipe body itself including a technology housing, a mouthpiece portion, and a smoking portion between the technology housing and mouthpiece portion. The technology housing includes a cavity therein, which can be utilized to hold the combustible material. The smoking portion defines a passageway for transporting gas from the technology housing to the mouthpiece portion. First and second electrodes are included within the cavity of the technology housing and/or within the smoking portion, and electronic circuitry is housed within the pipe body. The electronic circuitry is configured to provide electricity to the electrodes such that an electric arc is formed between the first and second electrodes.

One embodiment of a method according to the present disclosure of producing a pipe for inhalation of gas produced by combustible material comprises forming a technology housing with a cavity and an end aperture, a smoking portion defining a passageway, and a mouthpiece portion having an end aperture. The method further includes placing the smoking portion through the technology housing end aperture and attaching the smoking portion to the technology housing, and placing the mouthpiece portion over the smoking portion such that the smoking portion is through the mouthpiece portion end aperture. The technology housing is then attached to the mouthpiece portion such that the technology housing and mouthpiece portion are around the smoking portion.

One embodiment of a method according to the present disclosure for inhaling gas includes placing a combustible material in a cavity of a pipe's technology housing. The method further includes triggering an electrical arc between two electrodes within the cavity, the electrical arc causing combustion of the combustible material so as to form a gas.

That gas is then inhaled through a mouthpiece portion of the pipe, the mouthpiece portion being operably connected to the technology housing by a smoking portion. The electrical arc that is triggered is triggered by a user pressing a button or by a user inhaling from the mouthpiece portion.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIGS. 7A-7G are perspective, front, rear, right side, left side, top, and bottom views, respectively, of a pipe body according to an embodiment of the present disclosure.

DETAILED DESCRIPTION OF THE INVENTION

Figure 1A:
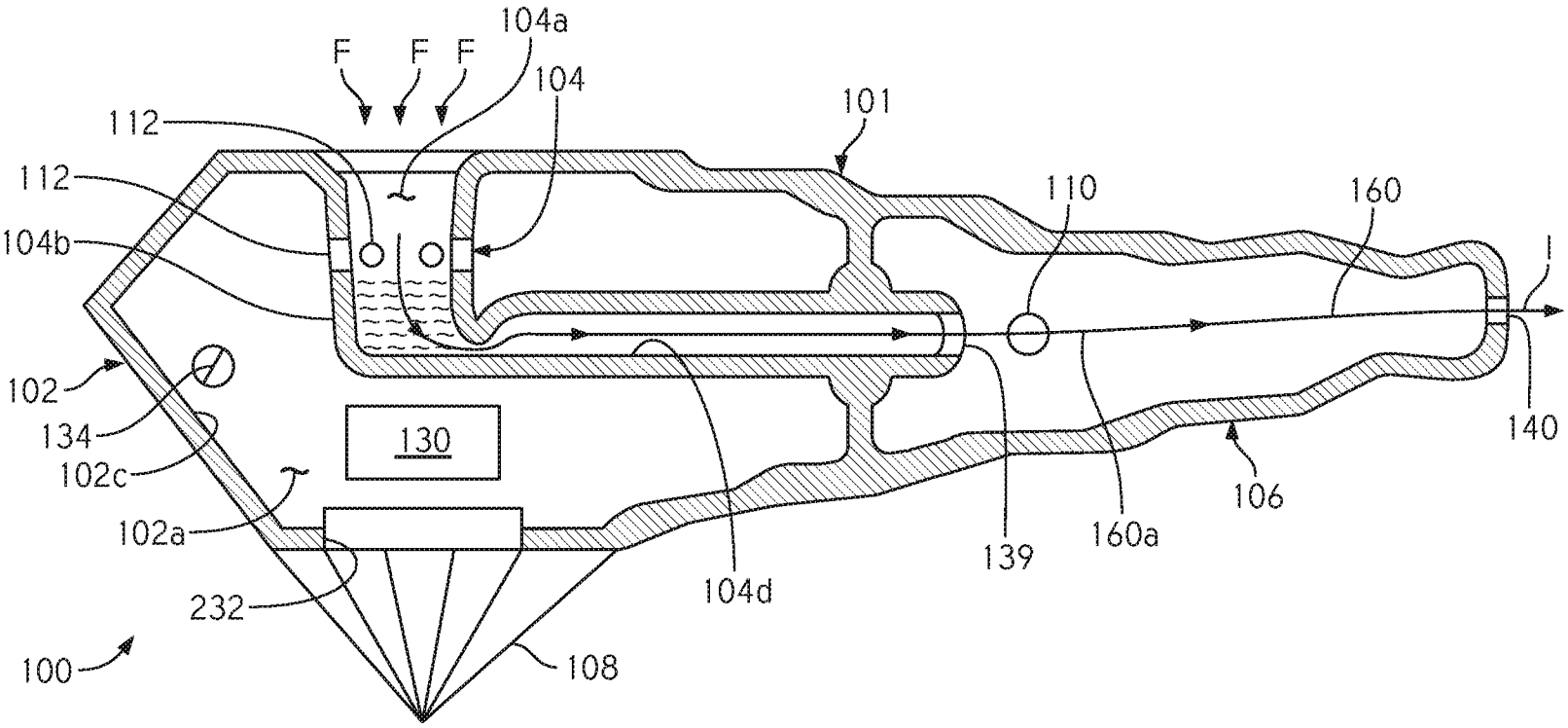
FIG. 1A is a side cutaway view of one embodiment of a pipe.

The present disclosure relates to devices for the inhalation of gases, such as smoke or vapor, produced from a combustible material such as tobacco or *cannabis*; as well to methods for producing these devices and methods for inhalation of such gases. Devices according to the present disclosure utilize one or more electrical arcs for the combustion of the desired combustible material as opposed to prior art methods that utilize, e.g., fire. The electrical arc or arcs produced by devices according to the present disclosure cause an electrical field that ionizes the incoming gas, which is typically ambient air, producing positive and negative ions. The succeeding apparatus then operates to cause a larger percentage of healthier, lighter, negatively ionized particles (as opposed to less healthy, heavier, positively ionized particles) to be carried through to be ingested by the user in the inhaled smoke. Methods for forming such devices, including methods for assembly that allow for access to electronic circuitry for forming the electrical arcs for, e.g., recharging purposes, are also described, as are methods for inhalation of the gas produced by the combustible material. The device allows the electronics that provide the arcing to be held in the device in a separated compartment that is sealed away from the smoking assembly, except that the wires, that is electrodes, that will produce the arc will pass from the separated compartment into the operational part of the device in a position above the combustible material, in which the passage is constructed to prevent any violation of the safe condition of the compartment as well as to bring the electrode into use to produce arcing.

Devices according to the present disclosure can in some embodiments be glass pipes combined with computer technology for smoking a combustible material such as tobacco or *cannabis*. In certain embodiments, the device includes a body comprised primarily of glass. In a particular design, the body/hull is crafted in the shape of a diamond, with a dripping tail of ectoplasm. The devices can be fumeless, futuristic, windproof, and self-igniting of the combustible material. The devices in one embodiment serve as a combination of a glass smoking device (e.g., pipe), and an ignition source (e.g., lighter) in an integrated structure. The devices can be portable and self-sufficient, and reduce exposure to unnecessary chemicals and combustible materials that are typically given off by lighters, torches, and wicks.

In a typical method of using a device according to the present disclosure, a device cavity or bowl is loaded with a combustible material of choice. The device employs ambient air mixing with smoke for inhalation. The user places the device's barrel or mouthpiece portion to his or her lips, then presses an ignition button or otherwise activates the device. This causes current to travel through electronic circuitry including, for example, low current wiring, to a battery, then to a protoboard where the current is converted into a coil. A corona or arc discharge is then released through high current wires or electrodes, often with a low current to high current arc of electricity through plasma in the air. As the combustible material of choice is heated by the electricity, gas such as smoke or vapor is released, and the subject inhales from the mouthpiece portion. The user can then deactivate the device such as by releasing the ignition button, stopping the arc or corona discharge. In some embodiments a carburetor is available, which is initially blocked for the inhalation. The user can then release the carburetor, allowing air to flow into the passageway for the inhalation. The user can then inhale the gas remaining in the device, clearing the device of that gas and replacing that gas with air. The device can include a plug or covering of the compartment that contains the electronics, that can be removed to replace and/or recharge a battery therein. One embodiment of a device according to the present disclosure is a glass smoking device that utilizes electrical corona or arc discharge to burn and/or ignite combustible material independently, without the use of external heat-producing implements. Devices according to the present disclosure can specifically be used for the purpose of consuming tobacco or *cannabis*. In particular embodiments, the arc is maintained during inhalation so as to ionize the ambient air that is pulled into the device during an inhalation, thereby producing positive and negative ions.

Throughout this description, the preferred embodiment and examples illustrated should be considered as exemplars, rather than as limitations on the present disclosure. As used herein, the term "disclosure," "method," "present disclosure," "present solution," "or present method," refers to any one of the embodiments of the disclosure described herein, any equivalents, and any additional embodiments that would be apparent to one of ordinary skill in the art. Furthermore, reference to various feature(s) of the "disclosure," "method," "present disclosure," "present solution," or "present method" throughout this document does not mean that all claimed embodiments or methods must include the referenced feature(s).

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present disclosure. When comparing two elements, a first element that is "upstream" of a second element is before the second element in the intended flow path as it would be understood by one of skill in the art, while a first element that is "downstream" of a second element is after the second element in the intended flow path.

The term "inhalation" or "inhale" as used in this description refers to the act of putting suction on the device to cause flow through the device. That suction is typically from the mouth of the user intended to cause the flow to enter as ambient air at the top of the pipe bowl (e.g., the cavity 104*a* discussed below) through the device while mixing with gas from a combustible material, to eventually pass into the user's mouth. It does not necessarily mean that the flow is inhaled into the user's lungs, although that would be regarded as a common way to use the device and method. A single inhalation could be, in common terminology, a puff, a drag or a toke.

The terminology used herein is for describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

FIG. 1A is a side cutaway view of a pipe 100 according to one embodiment of the present disclosure. The pipe 100 has a pipe body 101 including a technology housing portion 102, a smoking portion 104, a mouthpiece portion 106, and a closure portion 108. The smoking portion 104 has a cavity 104*a* that is defined by a wall 104*b* that separates the smoking portion 104 from the technology housing portion 102. While the technology housing 102, smoking portion 104, and mouthpiece portion 106 are shown in this embodiment as separate pieces (see FIGS. 2 and 3) that can be connected or attached to one another, it is understood that these portions may be interconnected and/or integral with one another. However, as the device is made, the result is a flow path 160 for flow that enters the cavity 104*a* at an entrance opening 104*c* (indicated by arrows F) and extends continuously to an inhalation exit 140 at the mouthpiece portion 106. The flow path 160 passes by electrodes which produce an arc, then through smoking subject matter 105 and on through the mouthpiece 140. The technology housing portion 102 includes a separated compartment 102*a* defined by a wall 102*c* that provides an open space to have electronics kept, that is protected from the smoking activity and allows electrodes to pass into the cavity 104*a* through openings 112 to create an arc A in the cavity 104*a* during inhalation as will be described and explained below. A carburetor 110, which can be a hole through the body 101 of the pipe 100, provides air access to the flow path 160 of gas flowing from the smoking portion 104 to the mouthpiece portion 106. In this embodiment the carburetor 110 is located in the mouthpiece portion 106 so as to be conveniently available to be closed by a user's finger.

Figure 1B:
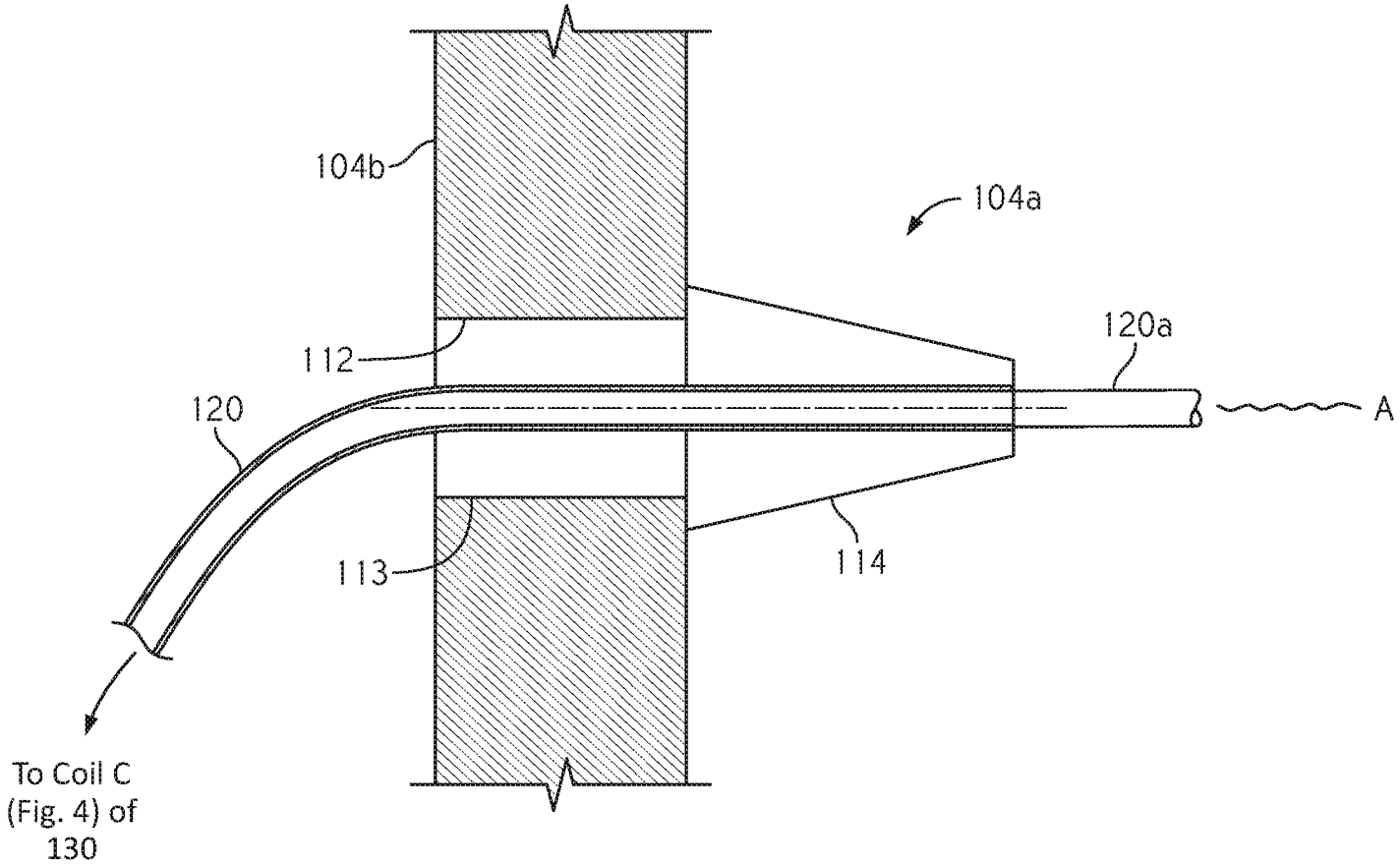
FIG. 1B is a detailed sectional view of an electrode wire in a fitting passing through the wall of a cavity of the pipe.
Figure 1C:
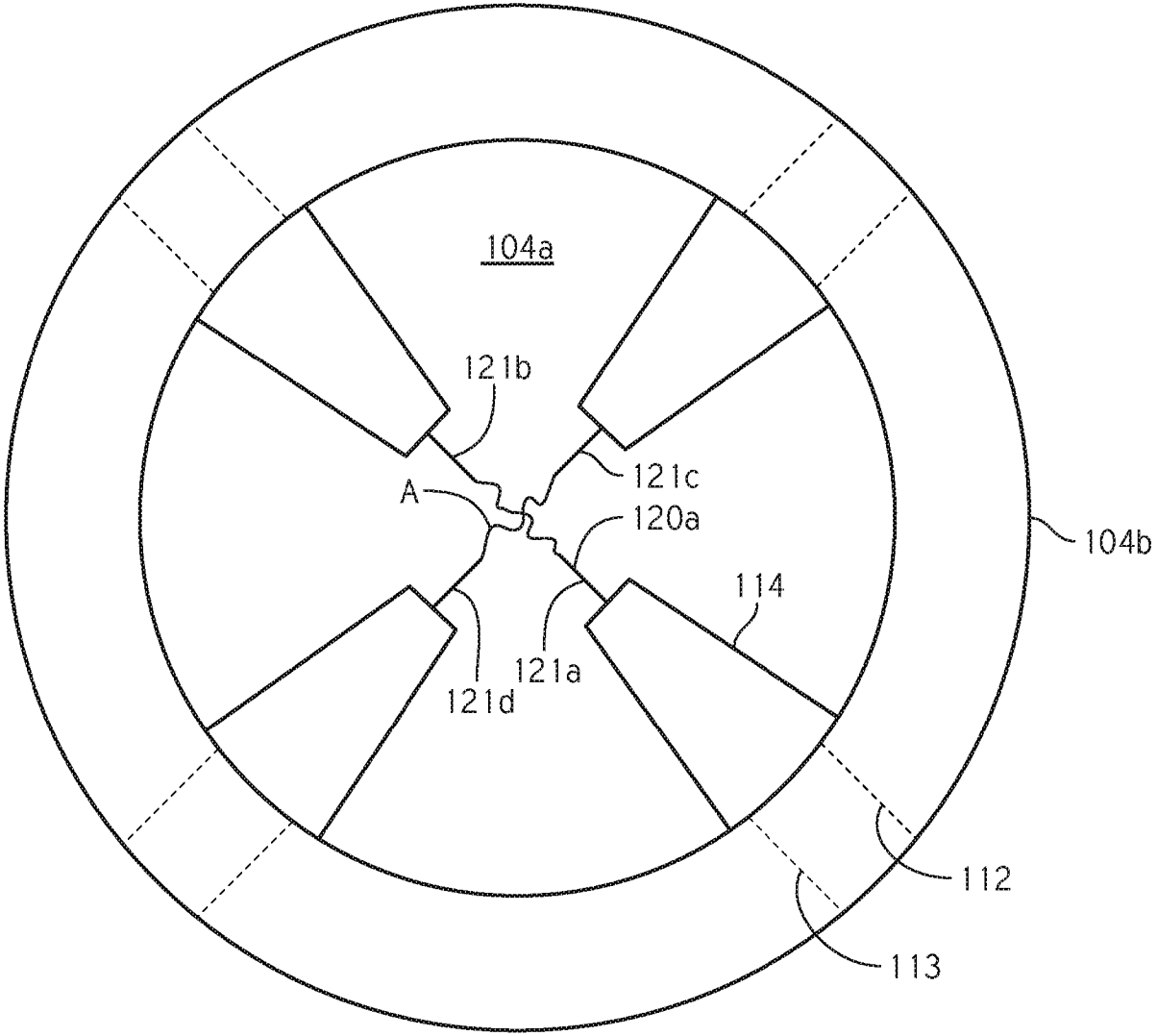
FIG. 1C is a plan view showing the electrodes and arc in the cavity.
Figure 4:
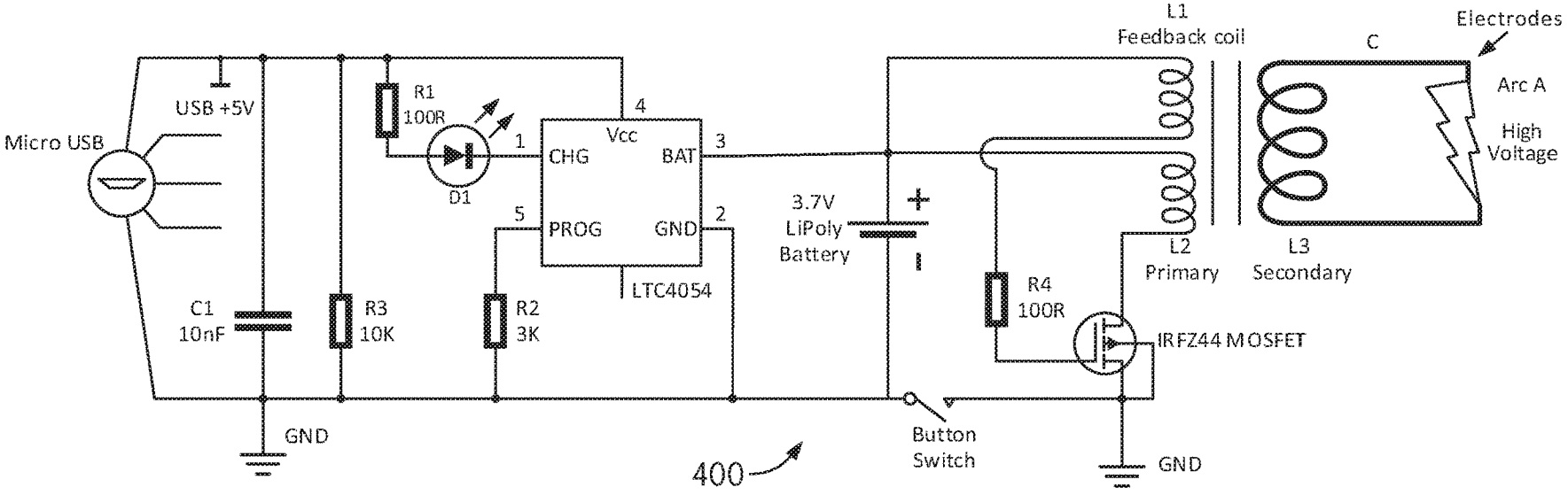
FIG. 4 is an electrical schematic that produces the arcing according to one embodiment of the present disclosure.

Now referring to FIGS. 1A, 1B and 1C, the structure for placing electrodes 120 in position in the cavity 104*a* will be described. The wall 104*b* which forms the cavity 104*a* has openings 112, in this embodiment four such openings. In the openings 112 there are fittings 114, which can be made of stainless steel, through which pass the wires that define the electrodes 120. The fittings have a seating cylinder 113 tightly set into the openings 112. Those wires can be of the TPC type, having a thermal coating as they pass through the fitting 114, the coating being removed on parts of the active electrode portions 120*a* that are inside the cavity 104*a*. The electrodes are employed as a pair mounted oppositely, which produce an electrical arc A. Two such pairs are shown, and the arcs pass across the space between the electrodes of each pair, each arc A crossing the other. In FIG. 4 an exemplary schematic circuitry is shown in which there is a coil C for each pair of electrodes to produce an arc A. The complementary paired active electrode portions 120*a* that terminate in the cavity 104*a* can be 4 millimeters or more apart from one another, or 6 millimeters or more apart from one another, or from about 4 to about 8 millimeters apart from one another, 6 to 7 millimeters being a more preferred distance. Such amounts of separation can aid in causing combustion of a loose and/or unpacked combustible material compared to prior art lighter electrodes, which may only be a few millimeters apart. The electrode portions 120*a* can be included in the cavity 104*a*, and the electronic circuitry 130 can be included in a compartment 132. The compartment 102*a* is shown as within the technology housing 102 of the pipe 100, such as below the cavity 104*a*, although other locations are possible. An electrical schematic 400 of one embodiment of the electronic circuitry 130 according to the present disclosure is shown in FIG. 4. The compartment 102*a* can be mechanically sealed from the cavity 104*a* such that gas produced from a combustible material therein does not reach the electronic circuitry 130. The electrodes 120*a* can be electrically connected through a wall of the cavity 104*a* to the electronic circuitry 130, and the wall sealed around that connection so as to prevent gas from leaking from the cavity 104*a* into the compartment 102*a*.

The electrodes 120*a* are positioned in to the cavity 104*a* of the smoking portion 104 through the wall 104*b*. The electronic circuitry 130 is operably linked to the electrodes 120*a*, to provide electricity to the electrodes 120*a* to the point where an electrical arc A is formed between complementary (paired) electrodes. For example, in the specific embodiment shown, four electrodes 121*a*,121*b*,121*c*,121*d* are included. A first electrical arc can be formed between the electrodes 121*a*,121*b*, and a second electrical arc can be formed between the electrodes 121*c*,121*d*, the two electrical arcs forming an X pattern. The arc between each pair is independently generated by the electronic circuit so that in effect there are two independently operating arcs, but which can operate together and simultaneously. Other embodiments are possible, such as embodiments including only two electrodes, embodiments including four electrodes that are connected by substantially parallel electrical arcs, and embodiments including six or more electrodes and/or three or more electric arcs.

Electrical arcs between electrodes can be caused by various different mechanisms. For instance, in one embodiment the electronic circuitry 130 can be activated by a user pressing an ignition button 134. In another embodiment, the electronic circuitry 130 can include a breath switch that activates upon a user inhaling from the mouthpiece portion 106 with a sufficient force, that force activating the electronic circuitry 130 to cause electrical arcs to be formed between the electrodes 120, and thus causing the combustion of combustible material within the cavity 102*a* and/or the cavity 104*a*.

FIG. 1A shows a typical flow path of air F entering the cavity 104*a* during an inhalation and passing the arc A (see FIGS. 1B and 1C) where it is heated and ionized. From that point on in this description it is referred to as a gas 160*a*, which then passes through the combustible material and then through the device 100 as shown by its path 160. The arc A also ignites the combustible material forming the smoke or in some embodiments there will be vapor, and giving off any available particulates that are combined with the ionized gas to provide a final gas mixture through the device and defining the composition of the inhalation I to the user. A user will typically light and/or heat the combustible material 105, such as by pressing the ignition button 134, and then by inhaling through the mouthpiece portion 140 take in the gas 160*a* as inhalation I. The user will typically inhale while electricity is arcing between the electrodes 120*a* and while the carburetor 110 is covered, such as by a user's thumb, to block excess air intake. This allows gas to build up within the pipe device 100 and along the flow path 160. Upon a user inhaling from the mouthpiece portion 140, air is drawn in and the gas is produced from the mixing of the ionized air and the combustible material 105. That gas 160*a* then follows the flow path 160. The gas 160*a* is drawn from the cavity 104*a* through a passageway 104*d* defined by the smoking portion 104, into the mouthpiece portion 106, through an inhalation aperture 140 of the mouthpiece portion 106, and finally into a user's mouth as inhalation I. A user can then release the ignition button 134 or otherwise stop electrical emission from the electrodes 120*a*, release or otherwise open the carburetor 110, and further inhale. This will allow more ambient air into the pipe device 100 and along the flow path 160, and as the user inhales, gas from the combustible material 105 that is within the pipe device 100 and along the flow path 160 will be cleared and replaced with that ambient air.

The use of electrical arcs to cause combustion of the combustible material 105 has distinct advantages over prior art methods. As shown in FIG. 1A, the combustible material 105 is most typically placed in the cavity 104*a* of the smoking portion 104. When an electrical arc is formed between electrodes 120*a*, at least some of the combustible material 105 is heated and/or lit so as to begin emitting a gas, such as smoke or vapor. This can be at least partially because of the heating of air particles that pass through the combustible material 105, causing combustion thereof. Additionally, and unlike in prior art flame-lit devices, an electrical field around the electrodes 120*a* is formed, causing ionization of the adjacent air, whether or not it has yet passed through the combustible material 105. As ionized air (e.g., plasma)

passes through the combustible material 105, an ionized gas is formed thereby, including both the ionized air and smoke and particulates from the combustible material 105.

Inhalation of negatively ionized gas has been shown to be healthier than inhalation of neutral or positively ionized gas, and can aid in the reduction of free radicals within the body that would otherwise be detrimental to one's health. Positively ionized particles are typically heavier than negatively ionized particles, for instance, due to protons being over 1000 times heavier than electrons. The healthier negatively ionized gas particles, being lighter than the positively ionized gas particles, will travel along the flow path 160 and through the passageway 104*b* of the smoking portion 104 faster than the positively ionized gas particles when a user inhales from the mouthpiece portion 106 as described above, resulting in a user inhaling a larger percentage of negatively ionized gas particles than in prior art devices. Positively ionized gas particles, on the other hand, will tend to stick to the surfaces of the device 100 as opposed to passing through it, and/or will stick to solid particulates such as ash formed from the remnants of the combustible material 105, those particulates in large measure remaining in the pathway of flow of the gas. These solid particulates themselves in some measure will stick to the surfaces of the device 100, and/or be caught by a screen that can be included along the desired flow path so as to prevent inhalation thereof. Such a screen can be included, for example, in the smoking portion 104, such as along the passageway 104*d* or in the mouthpiece portion 106. Many different embodiments and placements are possible.

Additionally, in advance of the inhalation, such as a few seconds, a user can activate the electronic circuitry 130 so as to form electrical arcs between the electrodes 120*a*, and thus to ionize the gas formed by the combustible material 105. This results in producing ionization to a greater extent and in a greater volume than is available when the arc activation and inhalation are simultaneous.

While the specific embodiment of the pipe 100 includes electrodes 120*a* that arc, it is understood that other embodiments are possible. For instance, certain embodiments of the present disclosure may not arc between electrodes but could instead initiate corona discharge at each electrode, that discharge causing an electric field that ionizes the air and/or gas nearby as previously described. It is understood that by definition a corona is comprised of ionized gas.

Figure 2:
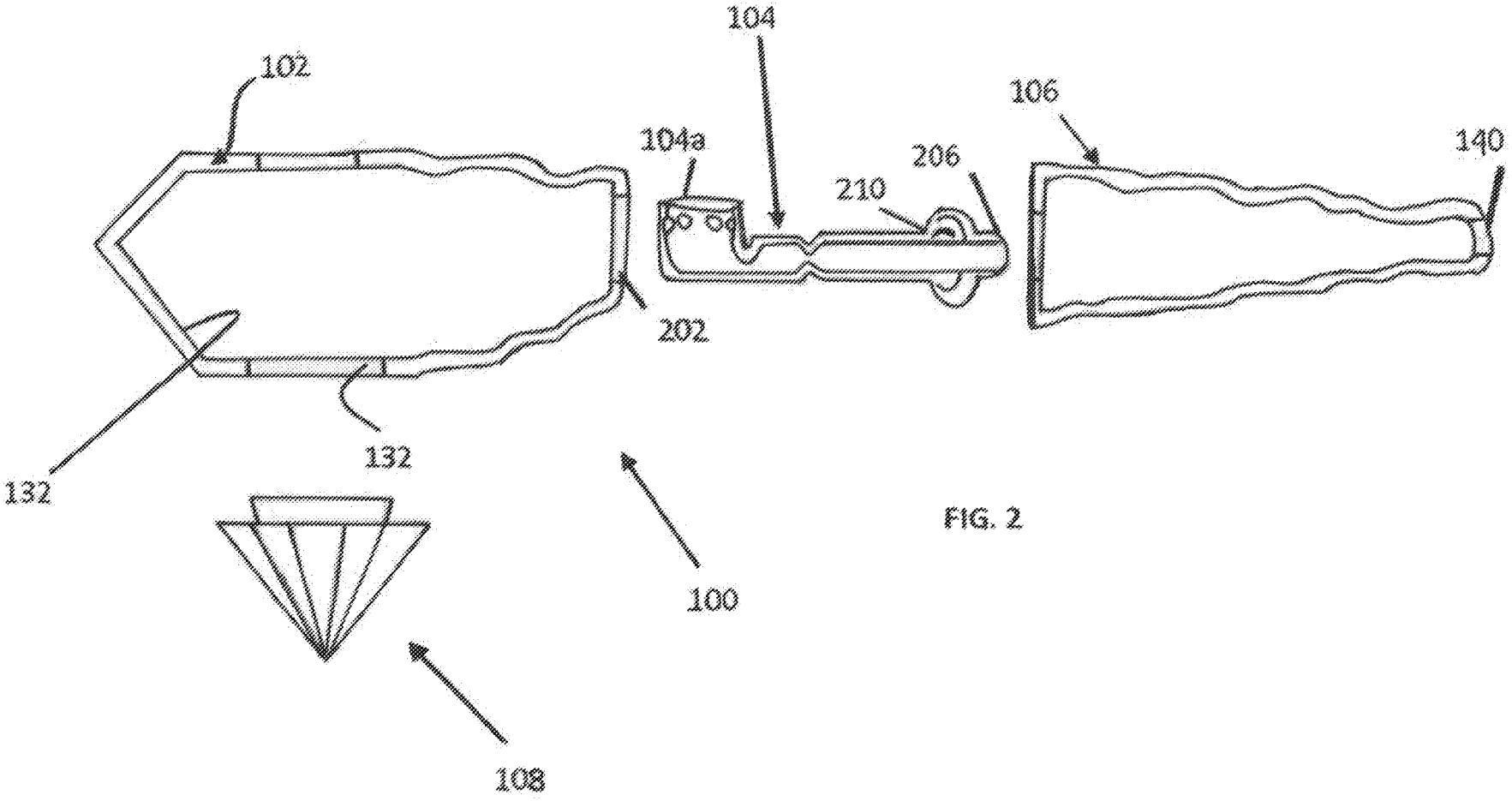
FIG. 2 is an exploded view of the embodiment the pipe shown in FIG. 1A.
Figure 3:
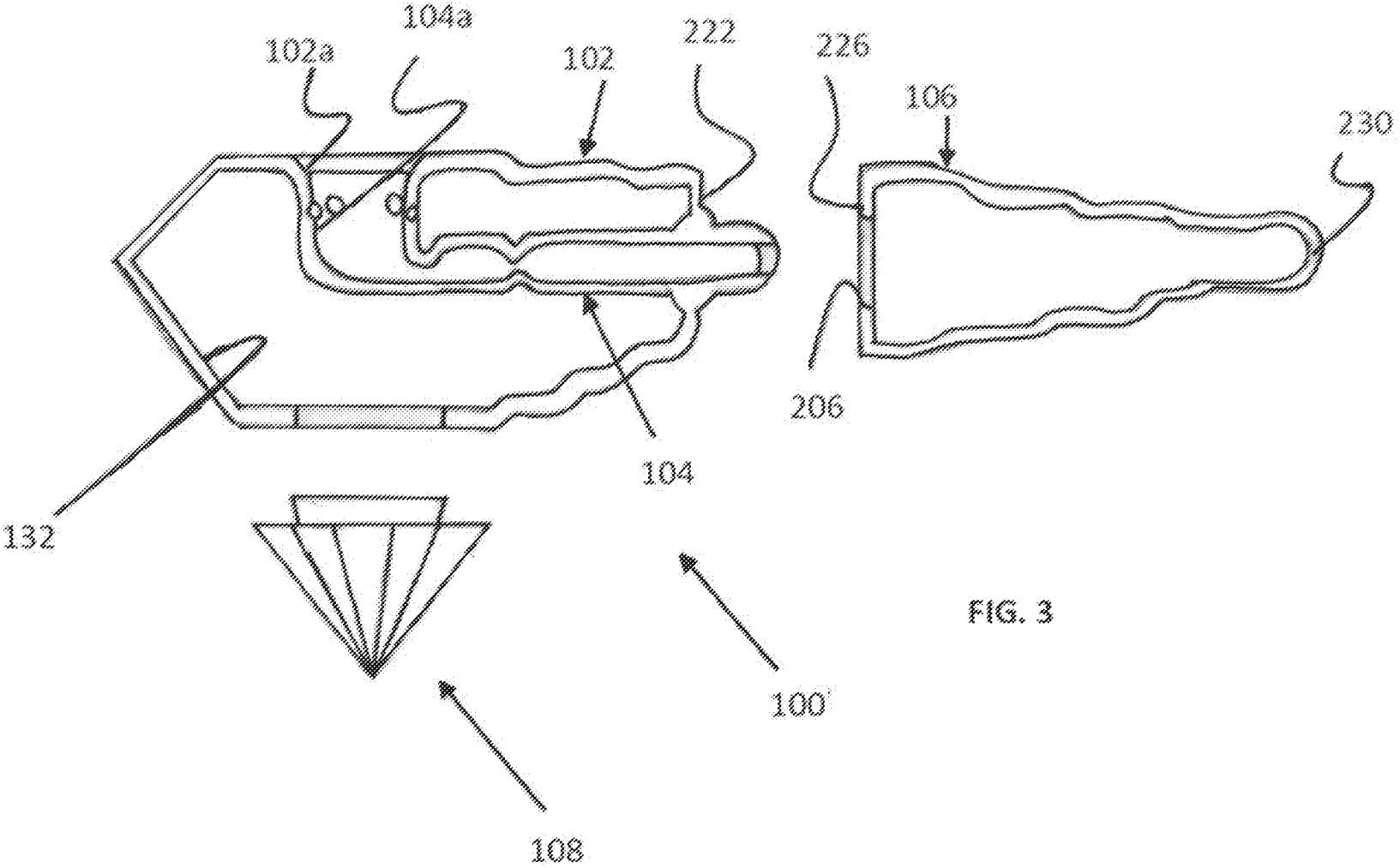
FIG. 3 is another exploded view of the embodiment of the pipe shown in FIG. 1A and FIG. 2.

FIGS. 2 and 3 show exploded views of the device 100, broken into its primary components: the technology housing portion 102, smoking portion 104, mouthpiece portion 106, and closure portion 108. In the assembly of the device 100, FIG. 2 represents an initial stage, and FIG. 3 represents an intermediate stage, and FIG. 1A represents the finished device. As shown best in FIG. 2, the technology housing portion 102 can include an end aperture 202. The smoking portion 104 can be placed through the technology housing end aperture 202, as shown in FIG. 3, and then attached to one another so as to form a connection between the technology housing opening 102*a* and the smoking portion cavity 104*a*. The smoking portion 104 can be attached to the technology housing portion 102 in one or more places. For example, in the embodiment shown, they are attached to one another around the edges of the cavities 102*a*,104*a*, and again at the technology housing end aperture 202. The smoking portion 104 can include an attachment portion 210 which can be attached proximate the technology housing end aperture 202. Attachment between portions of the device 100, including but not limited to the connections between the technology housing portion 102, smoking portion 104, and mouthpiece portion 106, can be attached in any manner known in the art, such as by welding, adhesives, fasteners, and other means. The construction and assembly of the portions as described herein is especially adapted for making the pipe 100 out of glass.

The mouthpiece portion 106 can include an end aperture 206, with the end aperture 206 formed in an attachment end 226 of the mouthpiece portion 106. The attachment end 226 and end aperture 206 can be placed over the smoking portion 104 such that the attachment end 226 abuts an attachment end 222 of the technology housing portion 102, and the attachment ends 222,226 can then be attached to one another, such as by welding. In this manner, a completed passageway for gas, such as smoke or vapor from a combustible material, is formed from the smoking portion cavity 104*a*, through the passageway 104*d*, into the mouthpiece portion 106, and finally through the inhalation aperture 140, as described above. Thus, upon gas being produced from the combustible material 105 within the cavity 104*a* a user can draw that gas through the inhalation aperture 140 as an inhalation.

As previously discussed, electronic circuitry 130 can be housed within a compartment in the device 100, such as the compartment 102*c* within the technology housing 102. FIG. 4 shows an electrical schematic 400 that is representative of one embodiment of the electronic circuitry 130. The electronic circuitry 130 can be placed in the compartment 102*a* through a technology port 232, which can be in the bottom of the device 100, such as the bottom of the technology housing portion 102. The technology port 232 can then be covered by the closure portion 108. The closure portion 108 can be, for instance, a removable plug as shown in FIGS. 2 and 3 or can attach in other manners known in the art, such as via a sliding clip connection. The closure portion 108 can be removed so as to allow access to the electronic circuitry 130 within the compartment 102*c*. As shown in FIG. 4, the electronic circuitry 130 can include a power source (e.g., a battery) and a recharging mechanism, such as a USB charger. As such, a user can remove the closure portion 108 and charge the electronic circuitry's power source for continued use of the device 100. Many different materials are possible for the closure portion 108, with some embodiments being elastic and/or pliable materials such as rubber or plastic. Also, for charging the battery a connector receptacle can be built into the wall of the plug, or if no plug is present then to the wall of another portion of the pipe body 101, to allow recharging without having to open the compartment.

The technology housing portion 102, smoking portion 104, and mouthpiece portion 106 can be made of various materials. In one embodiment, they are each made of glass such as borosilicate glass, which is well-suited for the device 100 due to its resistance to heat. Glass components can be formed via blowing, molding, or other methods as known in the art. Materials other than glass, such as polymers, composite materials, acrylic materials, polycarbonate materials, and other glass substitutes as known in the art are possible.

Figure 5A:
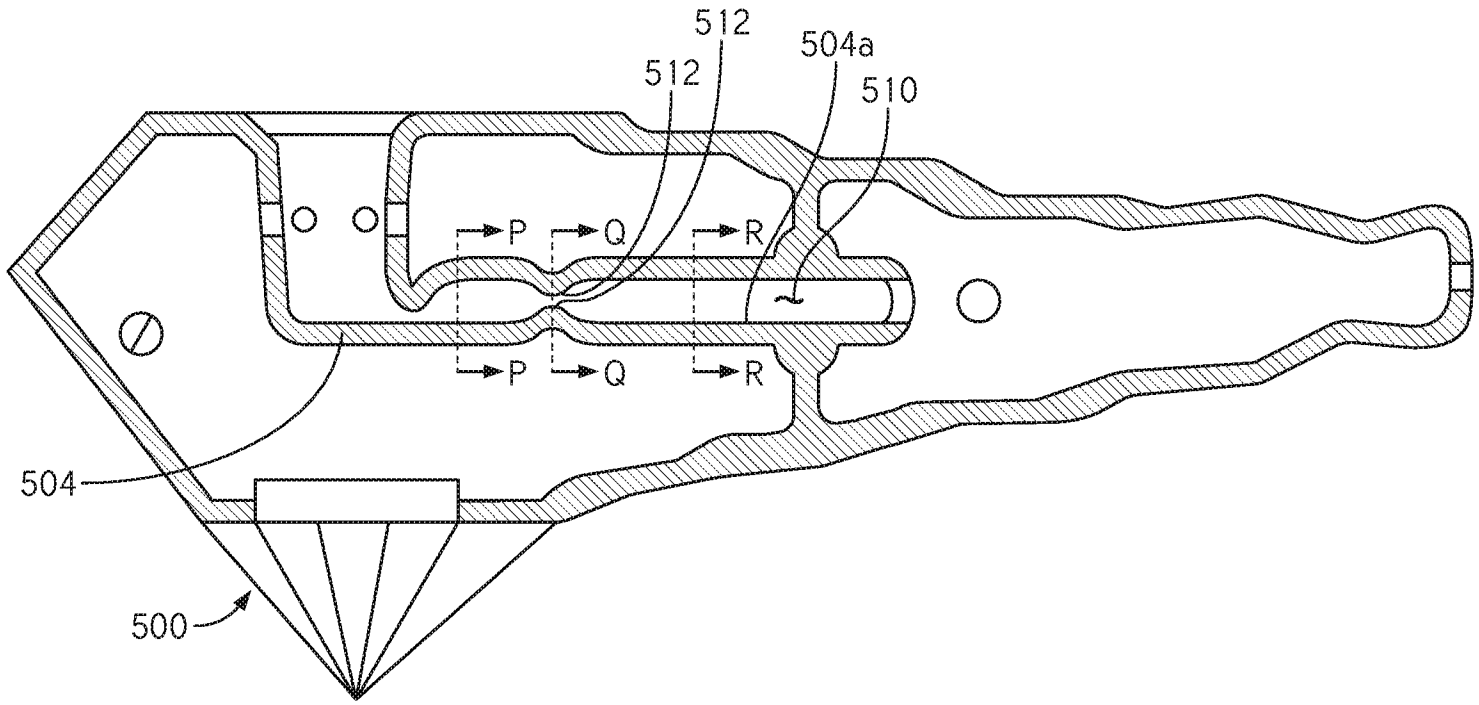
FIG. 5A is a cutaway view of a pipe showing pinching features in the path of inhaled gas and showing sectional view locations for FIGS. 5B and 5C.

Many variations of the device 100 are possible. For instance, some embodiments are designed to even further reduce the amount of positively ionized particles and/or solid particulates to be inhaled by a user via use of a pinch mechanism within the pathway of the gas produced by the combustible material. For instance, a pinch mechanism can be included in the smoking portion 104, such as in the passageway 104*b* from FIG. 1. FIG. 5A shows a cutaway side view of a device 500 that is similar to or the same as the device 100, other than the inclusion of a pinch mechanism 512. The pinch mechanism 512 can be in the smoking portion 504, such as in a passageway 510 therein, though it is understood that alternative placements of the pinch mechanism 512 within the flow path of gas from the combustible material to the user are possible, and it is understood that some embodiments include more than one pinch mechanism.

Figure 5B:
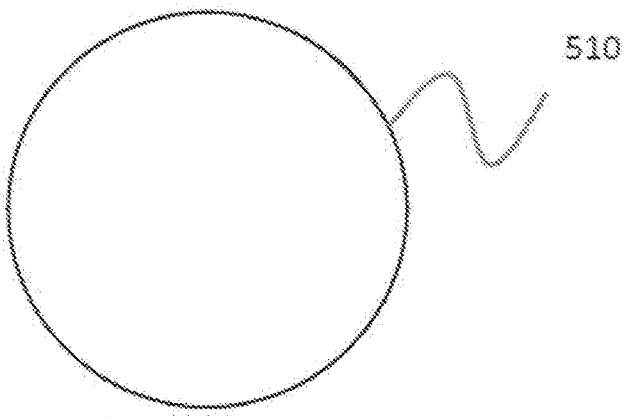
FIG. 5B is a cross-sectional view of the passage before and after the pinch at P-P and at R-R in FIG. 5A
Figure 5C:
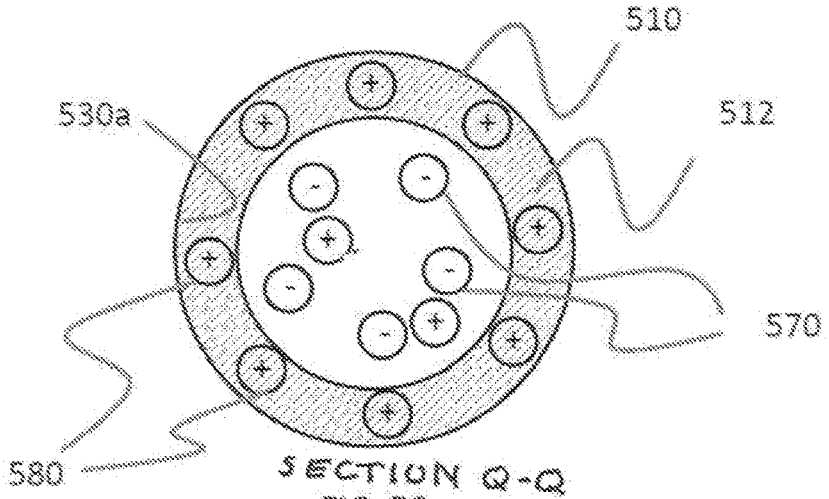
FIG. 5C is a cross-sectional view of the passage at the pinch at Q-Q in FIG. 5A.

FIGS. 5A and 5B show cross-sections P-P and R-R of the passageway 510 both upstream and downstream of the pinch mechanism 512. FIG. 5C shows a pinched cross-section Q-Q of the passageway 510, which includes the pinch mechanism 512, which can be a simple circular reduced cross-section or similar adjustment to reduce the cross-section. Pinch mechanisms according to the present disclosure, such as the pinch mechanism 512, reduce the cross-section through which gas can flow, thus aiding in the reduction of positively ionized particles and/or solid particulates that flow along the gas's flow path. The pinch mechanism 512 can be circumferential, and/or around substantially all or all of a perimeter of the passageway 510.

As previously discussed, positively ionized particles are typically heavier than their healthier negatively ionized counterparts. In a passageway such as the passageway 510, when a user is inhaling, the center of the passageway 510 typically includes the airflow having the fastest velocity, while portions of the passageway near its inner perimeter have slower velocities. As such, the pressure in the passageway 510 near its center is lower than the pressure near its perimeter. The lighter negatively ionized particles 570 will tend to be drawn to the center of the passageway 510, while the heavier positively ionized particles 580 and/or other solid particulates will tend to remain near the perimeter of the passageway 510 and/or attach to the perimeter wall. As such and as shown in FIG. 5C, a pinch mechanism such as the pinch mechanism 512 that is circumferential and/or around substantially all or all of the perimeter will trap more positively ionized particles 580 and particulates than negatively ionized particles 570, increasing the overall percentage of healthier, negatively ionized particles 570 that are inhaled by a user.

Figure 6:
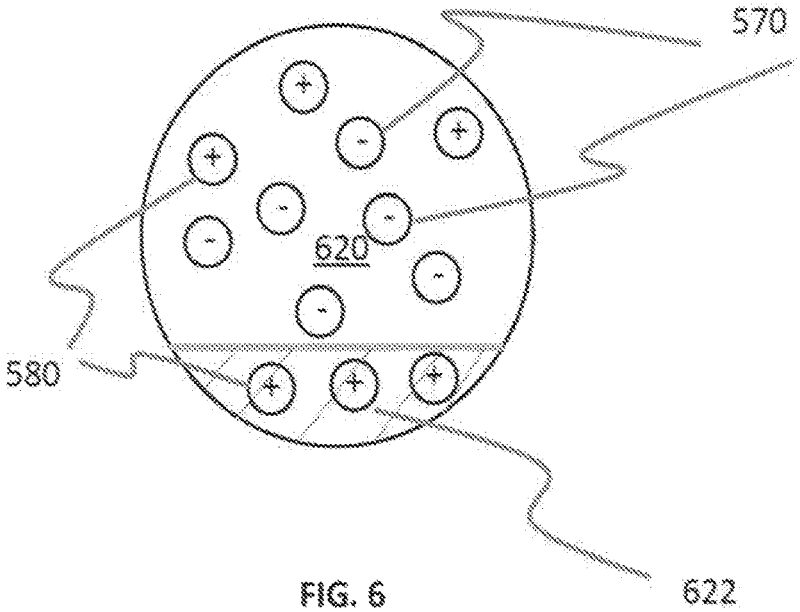
FIG. 6 is a cross-sectional view of a portion of yet another embodiment of a pipe according to the present disclosure at a pinch feature of that pipe.
Figure 7D:
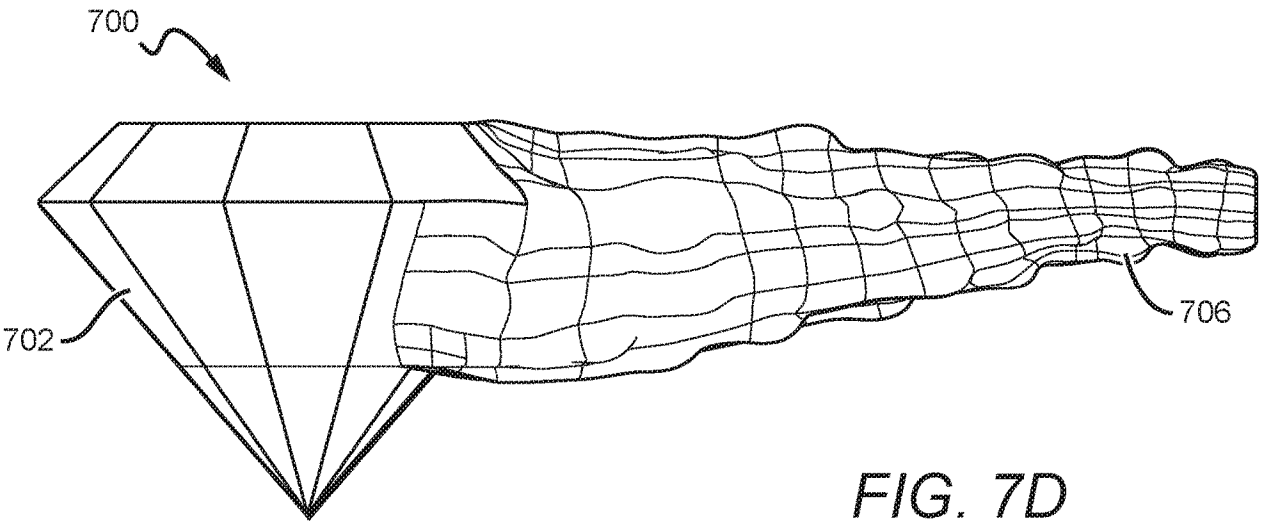
Figure 7E:
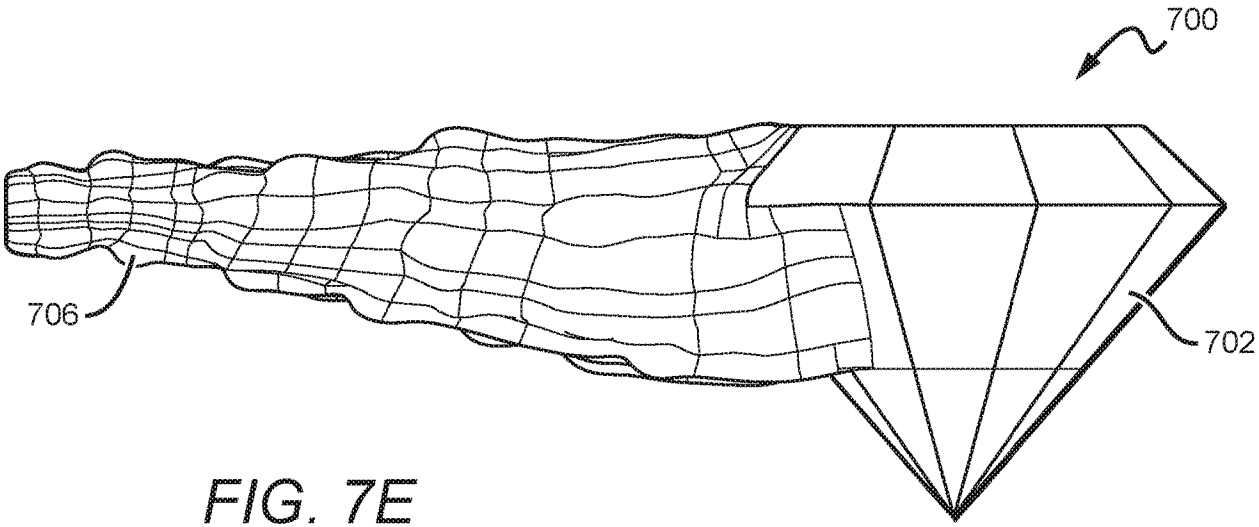
Figure 7G:
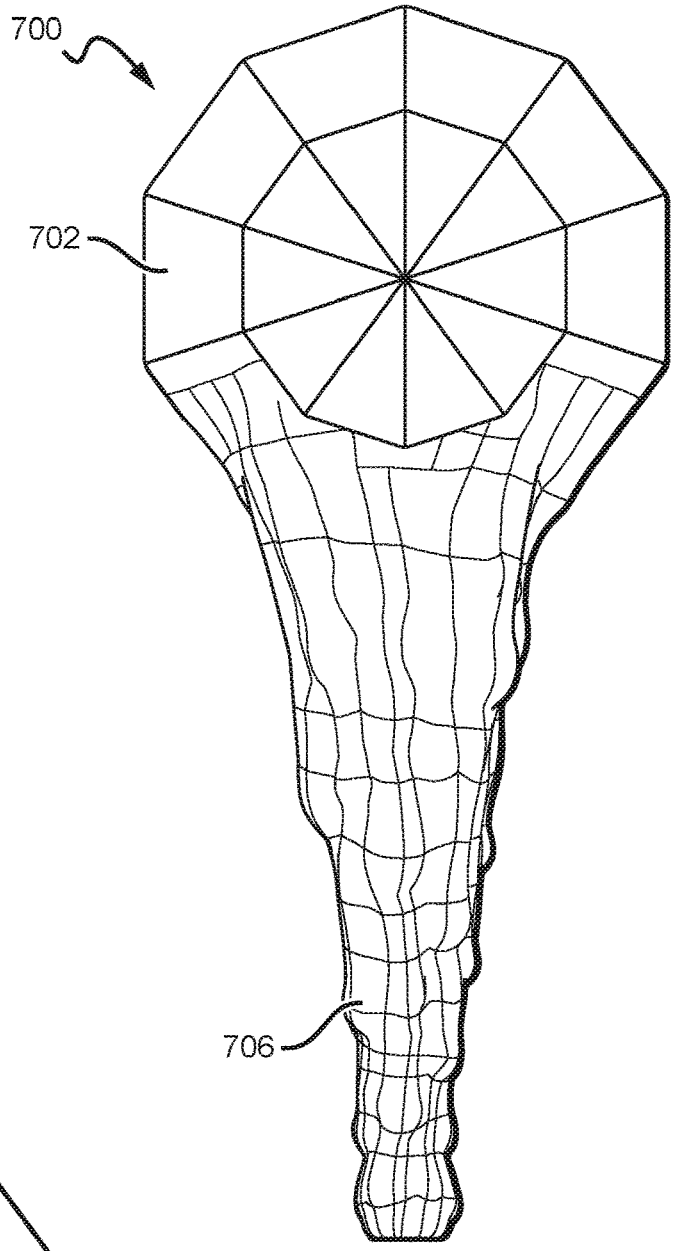
Figure 7F:
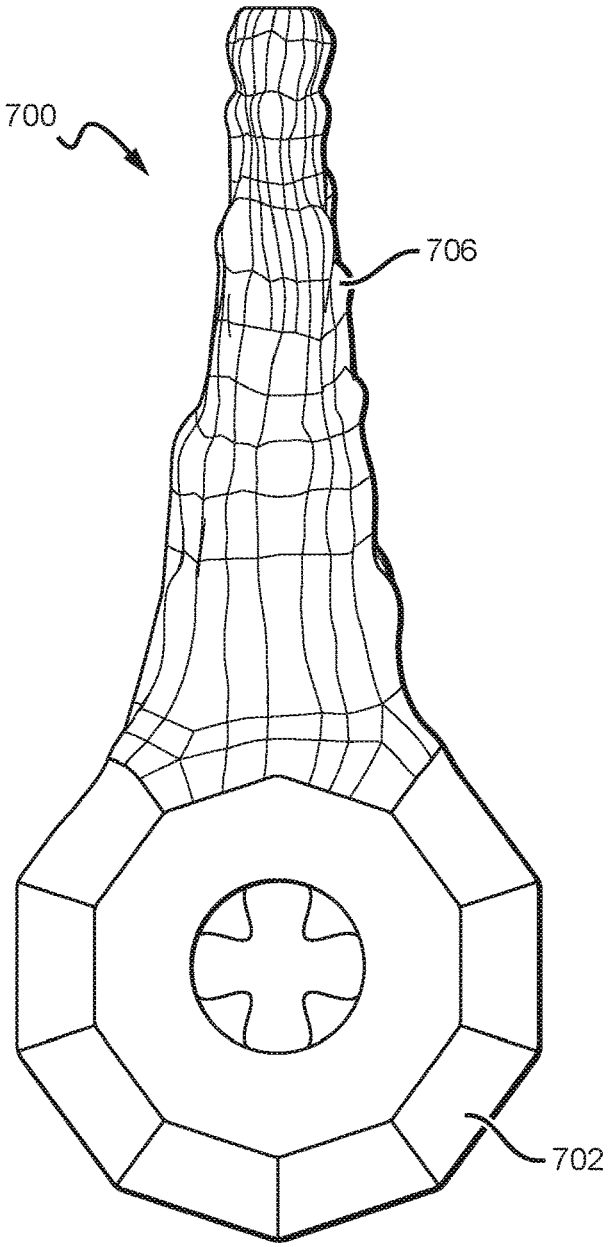

Many different shapes and sizes of pinch mechanisms are possible. For instance, pinch mechanisms can block 5% or more, 10% or more, 20% or more, 25% or more, 30% or more, 40% or more, 50% or more, less than 50%, 40% or less, 30% or less, 25% or less, 20% or less, or 10% or less of a passageway's total area. Other shapes are also possible. For instance, FIG. 6 shows an embodiment of a passageway 620 including a pinch mechanism 622 that blocks only the bottom part of the passageway 620, since heavier, positively ionized particles 580 and other solid particulates can tend to gravitate toward the bottom of a passageway. Many other shapes are possible.

FIGS. 7A-7G show perspective, front, rear, right side, left side, top, and bottom views, respectively of a pipe 700 according to one embodiment of the present disclosure. The pipe 700 can include a technology housing 702 and a mouthpiece portion 706 that are functionally similar or equivalent to the technology housing 102 and mouthpiece portion 106 previously described. The technology housing 702 and mouthpiece portion 706 can be attached to one another, such as via welding. The pipe 700 can include internal componentry that is functionally similar to or the same as the internal componentry of the pipe 100, such as a smoking portion that is similar to or equivalent to the smoking portion 104, electrodes that are similar to or the same as the electrodes 120.

Although the present disclosure has been described in detail with reference to certain preferred configurations thereof, other versions are possible. Embodiments of the present disclosure can comprise any combination of compatible features, and these embodiments should not be limited to those expressly illustrated and discussed. Therefore, the spirit and scope of the disclosure should not be limited to the versions described above. The foregoing is intended to cover all modifications and alternative constructions falling within the spirit and scope of the disclosure, wherein no portion of the disclosure is intended, expressly or implicitly, to be dedicated to the public domain if not set forth in any claims.

The invention claimed is:

1. A pipe for inhalation of gas produced by a combustible material, comprising:

a pipe body comprising:

a technology housing defining a technology housing cavity therein;

a mouthpiece portion having an outlet; and a smoking portion separate from the technology housing, the smoking portion having an open cavity with an inlet for air to enter the smoking portion defining a passageway for transporting the gas produced from the combustible material and the air to the mouthpiece portion;

first and second electrodes positioned within the technology housing cavity wherein active portions of the first and second electrodes extend into the open cavity of the smoking portion from openings on sides of the open cavity; and electronic circuitry housed within the pipe body, the electronic circuitry configured to provide electricity to the first and second electrodes so as to form a first electric arc between the active portions of the first and second electrodes, wherein the first electric arc ionizes the air in the open cavity and the smoking portion is arranged to hold the combustible material in the electric arc to combust the combustible material, wherein the smoking portion includes a pinch mechanism with reduced cross sectional area in said passageway, the pinch mechanism configured to prevent at least some positively charged ions and/or particulates from being inhaled by a user, and wherein the first and second electrodes, the technology housing cavity, the passageway with the pinch mechanism, and mouthpiece are configured such that gas transported from the technology housing to the mouthpiece portion includes more negatively charged ionized particles than positively charged ionized particles when exiting the mouthpiece portion.

2. The pipe of claim 1, wherein the active portions of the first and second electrodes are positioned on opposite sides of the open cavity.

3. The pipe of claim 1, further comprising one or more fittings positioned on the sides of the open cavity, wherein the first and second electrodes pass through the one or more fittings.

4. The pipe of claim 3, wherein the pipe body further comprises a removable closure portion for providing access to the electronic circuitry.

5. The pipe of claim 1, further comprising third and fourth electrodes, with active portions of the third and fourth electrodes extending into the open cavity, wherein the third and fourth electrodes are positioned to produce a second electric arc that crosses over the first electric arc.

6. The pipe of claim 1, wherein the combustion of the combustible material in the open cavity forms a combustion gas, and the combustion gas combines with the ionized air in the open cavity to provide an ionized inhalation gas.

7. The pipe of claim 1, further comprising a screen in the smoking portion for preventing at least some particulates from being inhaled by a user.

8. The pipe of claim 1, wherein the pinch mechanism is an integral part of the smoking portion.

9. The pipe of claim 1, wherein the pinch mechanism is around substantially all or all of a perimeter of the passageway.

10. The pipe of claim 1, wherein the pinch mechanism is at least a bottom of the passageway.

11. The pipe of claim 1, wherein the electronic circuitry comprises a breath switch.

* * * * *